US007466117B2

(12) United States Patent
Liao

(10) Patent No.: US 7,466,117 B2
(45) Date of Patent: Dec. 16, 2008

(54) MULTI-FUNCTION VOLTAGE REGULATOR

(75) Inventor: Tung-Tsai Liao, Hsin Chu (TW)

(73) Assignee: Sunplus Technology Co., Ltd., Hsin-Chu (TW)

( * ) Notice: Subject to any disclaimer, the term of this patent is extended or adjusted under 35 U.S.C. 154(b) by 13 days.

(21) Appl. No.: 11/882,023

(22) Filed: Jul. 30, 2007

(65) Prior Publication Data

US 2008/0030175 A1 Feb. 7, 2008

(30) Foreign Application Priority Data

Aug. 1, 2006 (TW) ..... 95128067 A

(51) Int. Cl.
*G05F 1/40* (2006.01)
*G05F 1/565* (2006.01)

(52) U.S. Cl. ..... 323/285; 323/274; 323/275; 323/284

(58) Field of Classification Search ..... 323/222, 323/226, 273, 280, 282, 274, 275, 284, 285
See application file for complete search history.

(56) References Cited

U.S. PATENT DOCUMENTS

2005/0017701 A1* 1/2005 Hsu ..... 323/282
2006/0267562 A1* 11/2006 Szepesi ..... 323/224
2007/0024256 A1* 2/2007 Chou ..... 323/268

* cited by examiner

*Primary Examiner*—Jessica Han
*Assistant Examiner*—Emily Pham
(74) *Attorney, Agent, or Firm*—Muncy, Geissler, Olds & Lowe, PLLC

(57) ABSTRACT

A multi-function voltage regulator for both DCDC function and LDO function includes a first transistor, a second transistor and a voltage control unit. The first transistor has a first terminal and a second terminal respectively connected to a first node and a second node. The second transistor has a first terminal and a second terminal respectively connected to the first node and a third node (voltage output node). The voltage control unit has a first output terminal and a second output terminal for respectively controlling actions of the first transistor and the second transistor so that an output voltage of the third node is a default voltage. The voltage control unit further has a first input terminal, a second input terminal and a ground terminal respectively connected to the second node, the third node and a ground node. The voltage control unit utilizes a voltage of the second node as a mode selection signal to select the DCDC function or LDO function.

6 Claims, 3 Drawing Sheets

MULTI-FUNCTION VOLTAGE REGULATOR

BACKGROUND OF THE INVENTION

This application claims the benefit of the filing date of Taiwan Application Ser. No. 095128067, filed on Aug. 1, 2006, the content of which is incorporated herein by reference.

1. Field of Invention

The invention relates to a voltage regulator for selecting DCDC (Direct Current to Direct Current) and LDO (Low Drop Output), and more particularly to a multi-function voltage regulator capable of selecting the DCDC or LDO without an extra input pad.

2. Related Art

FIG. 1 shows a conventional DCDC voltage regulator 10 in a boost mode. As shown in FIG. 1, the DCDC voltage regulator 10 increases the voltage of a power supply module 11 to a required output voltage Vout. That is, the voltage of the output voltage Vout is higher than the voltage of a voltage source B1. For example, the DCDC voltage regulator 10 increases the voltage of 1.5 volts to the voltage of 3.3 volts. The DCDC voltage regulator 10 includes the power supply module 11, a DCDC control unit 12 and two transistors Q1 and Q2. The power supply module 11 includes the voltage source B1 and an inductor L1 connected in series. The NMOS transistor Q1 has a source connected to a negative terminal of the power supply module 11, and a drain connected to a first node N1, which is connected to a positive terminal of the power supply module 11. The PMOS transistor Q2 has a source connected to the first node N1, and a drain connected to a third node N3 serving as a voltage output terminal. The DCDC control unit 12 further has an input terminal I1 for receiving the voltage of the third node N3. The DCDC control unit 12 outputs a control signal to control actions of the transistors Q1 and Q2 so that the output voltage Vout is held at a predetermined value.

FIG. 2 shows a conventional LDO voltage regulator 20. As shown in FIG. 2, the LDO voltage regulator 20 decreases the voltage of a power supply module 21 to a required output voltage Vout. That is, the voltage of the output voltage Vout is lower than that of the power supply module 21. For example, the LDO voltage regulator 20 decreases the voltage of 3 volts to the voltage of 1.8 volts. The LDO voltage regulator 20 includes the power supply module 21, a LDO control unit 22 and a transistor Q2. The PMOS transistor Q2 has a source connected to a first node N1 and a drain connected to a third node N3 serving as a voltage output terminal. The LDO control unit 22 outputs a control signal to control the action of the transistor Q2 so that the output voltage Vout is held at a predetermined value.

The voltage regulators in FIGS. 1 and 2 respectively utilize the DCDC control unit 12 and the LDO control unit 22, which are different from each other. The architecture and the control method of each of the DCDC control unit 12 and the LDO control unit 22 are well known in the art, so detailed descriptions thereof will be omitted.

In addition, a portable system often has two power systems for respectively providing a higher voltage and a digital core low voltage. The products often use the same integrated circuit and have to use one battery and two batteries, which may be a lithium battery. So, the same power processing system on the system has to transform the powers with different input voltages into an adapted voltage for the system. In order to simplify the circuit in the system, the circuit has to be used repeatedly, and the method for selecting different modes also has to be achieved stably without increasing the cost of the pad.

FIGS. 3 and 4 show voltage regulators having the DCDC and LDO functions, wherein FIG. 3 shows a DCDC voltage regulator 30 and FIG. 4 shows a LDO voltage regulator 40. Referring to FIG. 3, the DCDC voltage regulator 30 similar to FIG. 1 includes a power supply module 11, a voltage control unit 32, and two transistors Q1 and Q2. The voltage control unit 32 and the two transistors Q1 and Q2 are designed in an integrated circuit (IC), as illustrated by the dashed line 35. The voltage control unit 32 also has an additional input terminal I2 for receiving a selection signal, and the selection signal is inputted by the extra pad PA of the integrated circuit 35. In this embodiment, when the selection signal is a ground signal, the voltage regulator is the DCDC voltage regulator. The source of the NMOS transistor Q1 is connected to the negative terminal of the power supply module 11 through the pad of the integrated circuit 35.

Referring to FIG. 4, the LDO voltage regulator 40 similar to FIG. 3 includes a power supply module 21, a voltage control unit 32 and two transistors Q1 and Q2. The LDO voltage regulator 40 and the LDO voltage regulator 30 have almost the same architecture except that the pad PA of the LDO voltage regulator 40 is connected to the positive terminal of the power supply module 21 while the pad PA of the LDO voltage regulator 30 is connected to the negative terminal of the power supply module 21. So, as shown in FIGS. 3 and 4, the DCDC voltage regulator 30 and the LDO voltage regulator 40 use the same voltage control unit 32, and utilize the extra pad PA to serve as input terminal for the selection signal.

As mentioned hereinabove, the voltage regulators in FIGS. 1 and 2 use different control units (i.e., the DCDC control unit 12 and the LDO control unit 22), while the voltage regulators in FIGS. 3 and 4 use the same voltage control unit 32. However, the voltage regulators in FIGS. 3 and 4 need the extra pad PA to serve as the input terminal for different functions of selection signal.

SUMMARY OF THE INVENTION

It is therefore an object of the invention to provide a DCDC/LDO multi-function voltage regulator capable of correctly judging the DCDC or LDO function using the same voltage control unit without an extra pad.

To achieve the above-identified object, the invention provides a DCDC/LDO multi-function voltage regulator for increasing or decreasing a voltage of a power supply module and then generating an output voltage. The multi-function voltage regulator includes a first transistor, a second transistor and a voltage control unit. The first transistor has a first terminal and a second terminal respectively connected to a first node and a second node. The first node is connected to a positive terminal of the power supply module. The second transistor has a first terminal and a second terminal respectively connected to the first node and a voltage output node. The voltage control unit has a first output terminal and a second output terminal for respectively controlling actions of the first transistor and the second transistor so that the output voltage is a default voltage. The voltage control unit further has a first input terminal, a second input terminal and a ground terminal, which are respectively connected to the second node, the voltage output node and a ground node. The ground node is connected to a negative terminal of the power supply module. The voltage control unit utilizes a voltage of the second node as a mode selection signal for the DCDC or LDO.

When the second node is connected to the negative terminal of the power supply module, the voltage regulator increases the voltage of the power supply module. When the second node is connected to the positive terminal of the power supply module, the voltage regulator decreases the voltage of the power supply module.

Further scope of the applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus are not limitative of the present invention, and wherein.

DETAILED DESCRIPTION OF THE INVENTION

The present invention will be apparent from the following detailed description, which proceeds with reference to the accompanying drawings, wherein the same references relate to the same elements.

The DCDC/LDO voltage regulator of the invention will be described with reference to the accompanying drawings.

Figure 5:
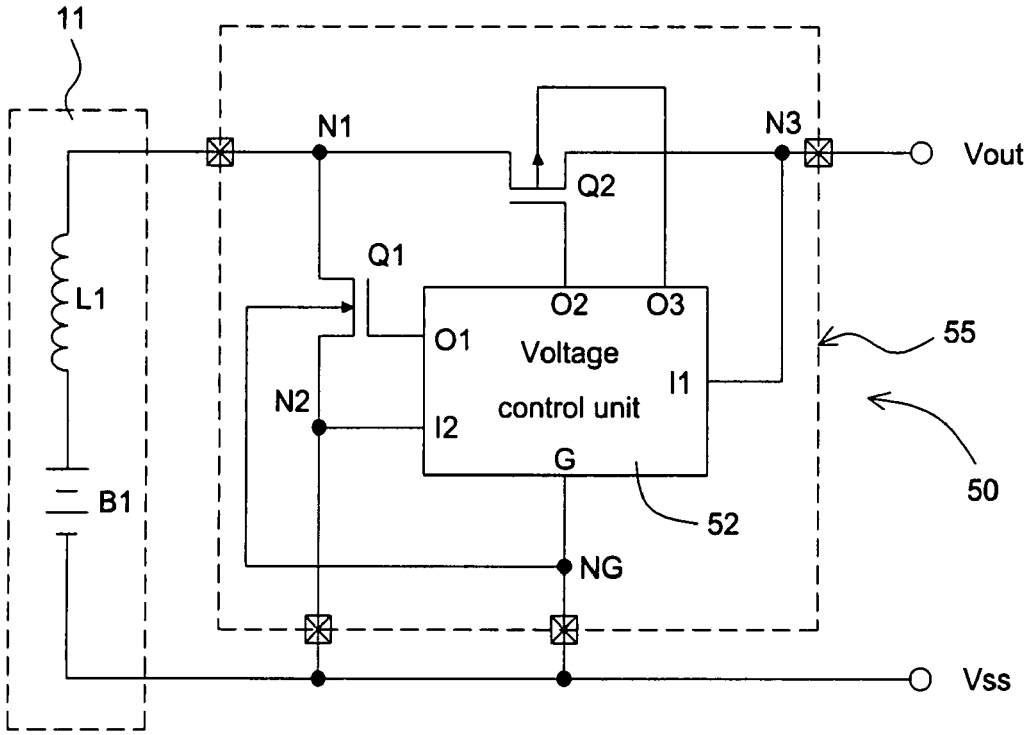
FIG. 5 shows a DCDC voltage regulator for the DCDC and the LDO according to the invention.
Figure 6:
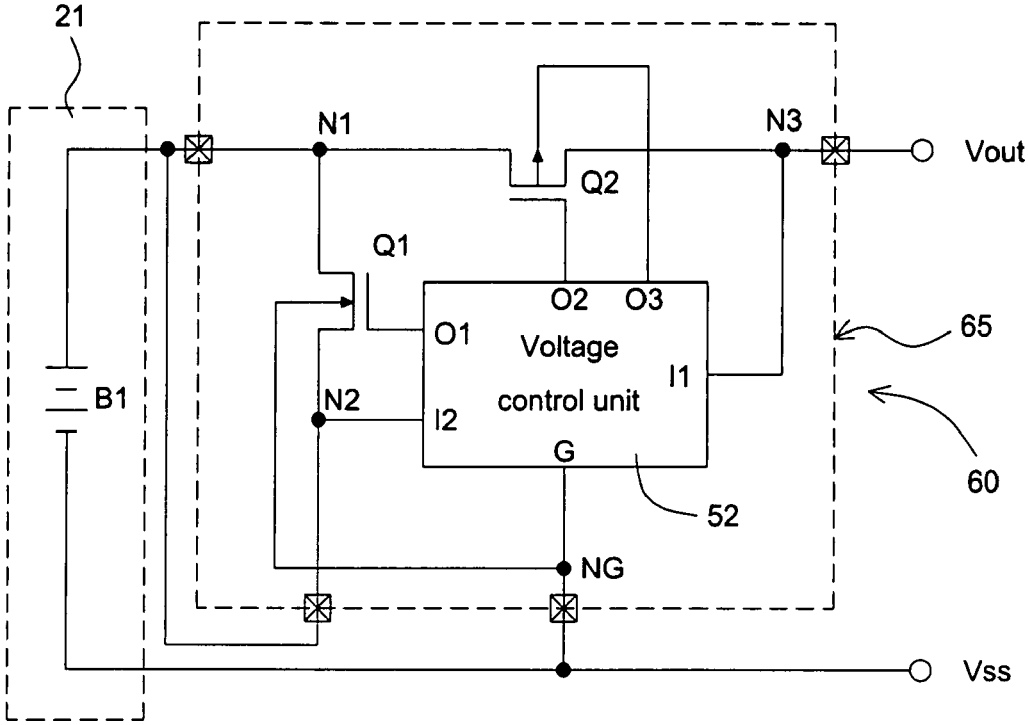
FIG. 6 shows a LOD voltage regulator for the DCDC and the LDO according to the invention.

FIGS. 5 and 6 respectively show DCDC and LDO multi-function voltage regulators according to the invention, wherein the voltage regulator of FIG. 5 has the DCDC function, and the voltage regulator of FIG. 6 has the LDO function.

Figure 1:
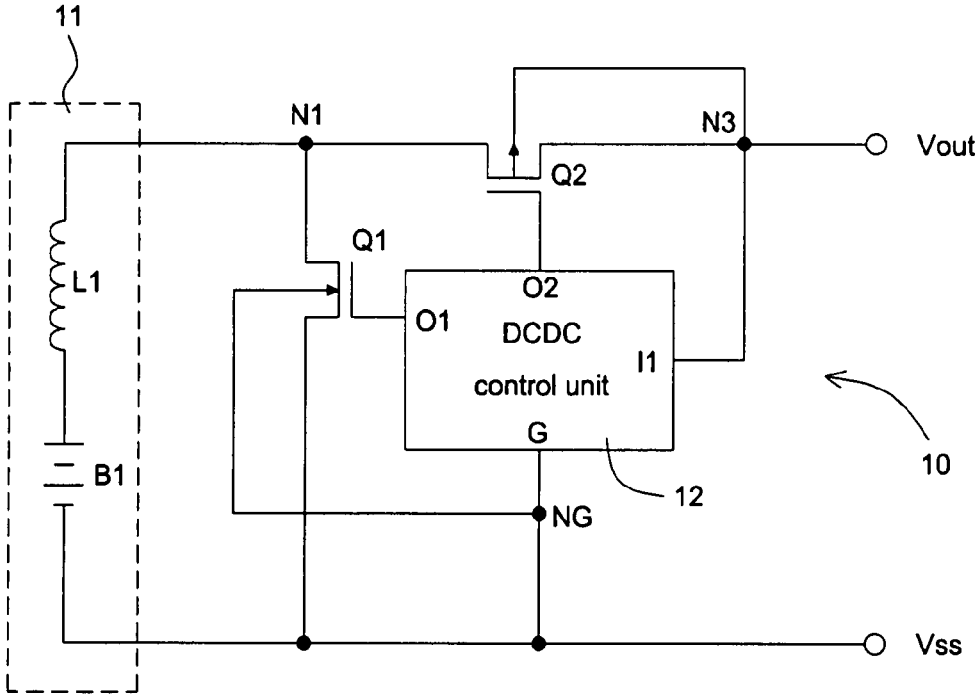
FIG. 1 (PRIOR ART)
FIG. 1 shows a conventional DCDC voltage regulator in a boost mode.
Figure 2:
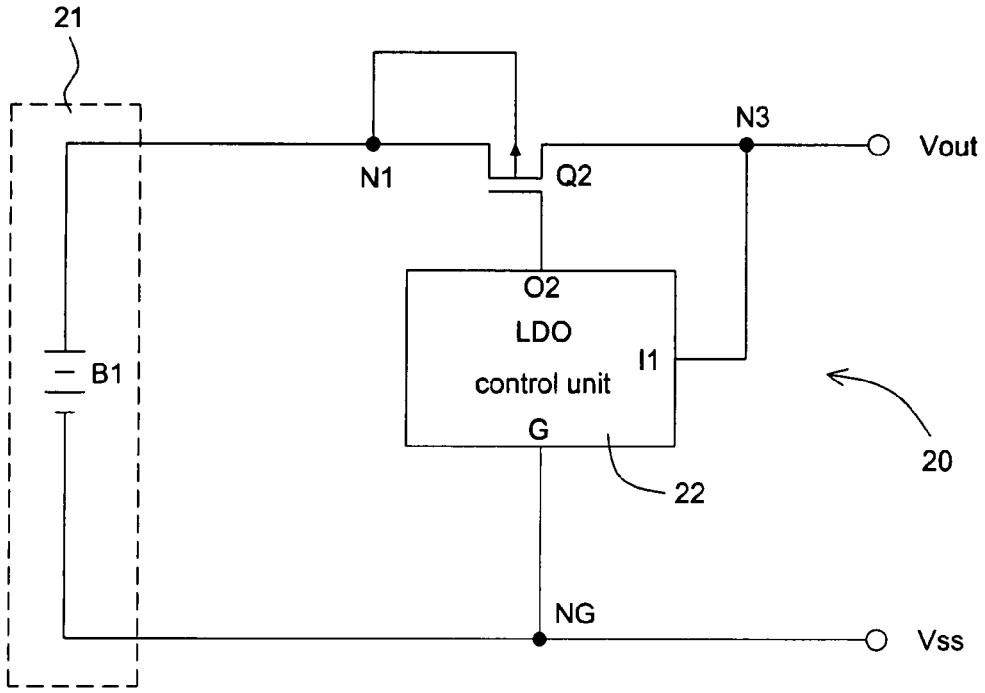
FIG. 2 (PRIOR ART)
FIG. 2 shows a conventional voltage regulator for implementing the LDO using the architecture of FIG. 1.
Figure 3:
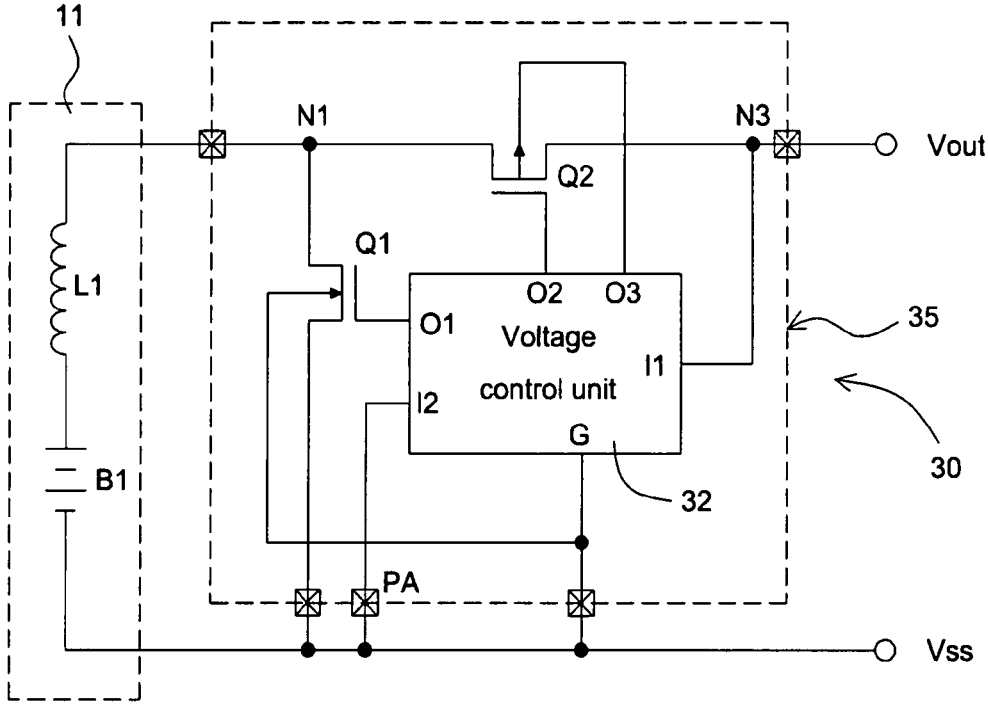
FIG. 3 (PRIOR ART)
FIG. 3 shows a conventional DCDC voltage regulator for the DCDC and the LDO.

Referring to FIG. 5, the voltage regulator 50 with the DCDC function is similar to that of FIG. 3 and includes a power supply module 11, a voltage control unit 52 and two transistors Q1 and Q2, wherein the voltage control unit 52 and the two transistors Q1 and Q2 are designed in an integrated circuit 55. In this embodiment, the power supply module 11 includes a voltage source B1 (e.g., a dry cell) and an inductor L1 connected in series. The first transistor Q1, which is an NOMS transistor in this embodiment, has a first terminal (drain) connected to a first node N1, and a second terminal (source) connected to a second node N2. The second transistor Q2, which is a PMOS transistor in this embodiment, has a first terminal (source) connected to the first node N1, and a second terminal (drain) connected to a third node N3. The voltage control unit 52 has a first output terminal O1, a second output terminal O2, a first input terminal I1, a second input terminal I2 and a ground terminal G. The first output terminal O1 and the second output terminal O2 respectively control gates of the transistors Q1 and Q2 so that an output voltage Vout can be held at a default voltage. In the architecture of the DCDC voltage regulator, the first node N1 is connected to a positive terminal of the power supply module 11, the second node N2 is connected to a negative terminal Vss of the power supply module 11 through one pad, a ground node is also connected to the negative terminal Vss of the power supply module 11 through another pad, and the third node N3 serves as a voltage output terminal. The first input terminal I1 and the second input terminal I2 of the voltage control unit 52 are respectively connected to the third node N3 and the second node N2, and the ground terminal G of the voltage control unit 52 is connected to the ground node.

Referring to FIG. 6, the voltage regulator 60 with the LDO function includes a power supply module 61, a voltage control unit 52 and two transistors Q1 and Q2. The architecture of FIG. 6 is similar to that of FIG. 5 except that the power supply module 61 only includes one voltage source B1, and the second node is connected to the positive terminal of the power supply module 11 through the pad. Since the transistor Q1 does not have to turn on in the voltage regulator with the LDO function, the second node N2 is connected to the positive terminal of the power supply module 11 through the pad in this embodiment. Thus, it is possible to prevent the transistor Q1 from turning on due to the noise or other reasons. On the other hand, the high potential of the second node N2 may serve as the selection signal for the LDO function.

Figure 4:
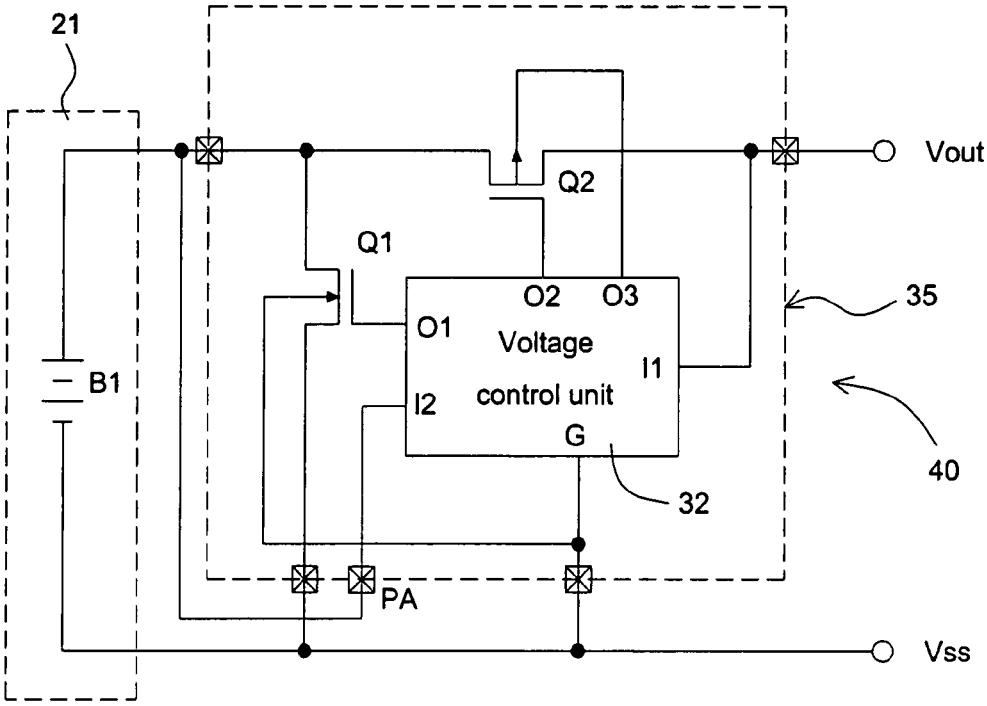
FIG. 4 (PRIOR ART)
FIG. 4 shows a conventional LDO voltage regulator for the DCDC and the LDO.

Thus, as shown in FIGS. 5 and 6, the voltage regulator 50 with the DCDC function and the voltage regulator 60 with the LDO function use the same voltage control unit 52 and the same transistors Q1 and Q2, and utilize a source voltage (second node voltage) of the NOMS transistor Q1 as the selection signal to replace the extra input signal. Therefore, the DCDC and LDO multi-function voltage regulators of the invention use the same voltage control unit and can correctly judge the function of DCDC or LDO without the extra pads (e.g., the pads PA shown in FIGS. 3 and 4). That is, the integrated circuit in each of the voltage regulators of FIGS. 3 and 4 requires five pads, while the integrated circuit only needs four pads in the voltage regulator of the invention. The architecture and the control method of the voltage control unit 52 pertain to the prior art, so detailed descriptions thereof will be omitted.

While the invention has been described by way of examples and in terms of preferred embodiments, it is to be understood that the invention is not limited thereto. To the contrary, it is intended to cover various modifications. Therefore, the scope of the appended claims should be accorded the broadest interpretation so as to encompass all such modifications.

What is claimed is:

1. A multi-function voltage regulator for increasing or decreasing a voltage of a power supply module and then generating an output voltage, the multi-function voltage regulator comprising:

a first transistor, having a gate, a first terminal connected to a first node, and a second terminal connected to a second node, wherein the first node is connected to a positive terminal of the power supply module;

a second transistor, having a gate, a first terminal connected to the first node, and a second terminal connected to a third node serving as a voltage output node; and a voltage control unit, which has a first output terminal and a second output terminal for respectively controlling the first transistor and the second transistor so that the output voltage is a default voltage, wherein the voltage control unit further has a first input terminal connected to the second node, a second input terminal connected to the voltage output node and a ground terminal connected to a ground node which is connected to a negative terminal of the power supply module, and the voltage control unit utilizes a voltage of the second node as a mode selection signal for DCDC function or LDO function;

wherein the multi-function voltage regulator is a DCDC voltage regulator for increasing the voltage of the power supply module when the second node is connected to the negative terminal of the power supply module, and the multi-function voltage regulator is an LDO voltage regulator decreasing the voltage of the power supply module when the second node is connected to the positive terminal of the power supply module.

2. The voltage regulator according to claim 1, wherein when the second node is connected to the negative terminal of the power supply module, the power supply module comprises a voltage source and an inductor connected in series.

3. The voltage regulator according to claim 1, wherein when the second node is connected to the positive terminal of the power supply module, the power supply module is a voltage source.

4. A multi-function voltage regulator for increasing or decreasing a voltage of a power supply module and then generating an output voltage, the multi-function voltage regulator comprising:

an NMOS transistor, having a drain connected to a first node, and a source connected to a second node, wherein the first node is connected to a positive terminal of the power supply module;

a PMOS transistor, having a source connected to the first node, and a drain connected to a third node serving as a voltage output node; and a voltage control unit, which has a first output terminal and a second output terminal for respectively controlling the NMOS transistor and the PMOS transistor so that the output voltage is a default voltage, wherein the voltage control unit further has a first input terminal connected to the second node, a second input terminal connected to the voltage output node and a ground terminal connected to a ground node which is connected to a negative terminal of the power supply module, and the voltage control unit utilizes a voltage of the second node as a mode selection signal for DCDC function or LDO function;

wherein the multi-function voltage regulator is a DCDC voltage regulator for increasing the voltage of the power supply module when the second node is connected to the negative terminal of the power supply module, and the multi-function voltage regulator an LDO voltage regulator for decreasing the voltage of the power supply module when the second node is connected to the positive terminal of the power supply module.

5. The voltage regulator according to claim 4, wherein when the second node is connected to the negative terminal of the power supply module, the power supply module comprises a voltage source and an inductor connected in series.

6. The voltage regulator according to claim 4, when the second node is connected to the positive terminal of the power supply module, the power supply module is a voltage source.

* * * * *